US011501897B2

(12) United States Patent
Kim et al.

(10) Patent No.: US 11,501,897 B2
(45) Date of Patent: Nov. 15, 2022

(54) WIRING MEMBER

(71) Applicant: Sumitomo Wiring Systems, Ltd., Yokkaichi (JP)

(72) Inventors: Kyungwoo Kim, Yokkaichi (JP); Toshinari Kobayashi, Yokkaichi (JP); Hironobu Yamamoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 17/279,180

(22) PCT Filed: Sep. 6, 2019

(86) PCT No.: PCT/JP2019/035129
§ 371 (c)(1),
(2) Date: Mar. 24, 2021

(87) PCT Pub. No.: WO2020/066546
PCT Pub. Date: Apr. 2, 2020

(65) Prior Publication Data

US 2021/0398711 A1 Dec. 23, 2021

(30) Foreign Application Priority Data

Sep. 26, 2018 (JP) ..... JP2018-179890

(51) Int. Cl.
*H01B 7/282* (2006.01)
*H01B 7/00* (2006.01)
(Continued)

(52) U.S. Cl.
CPC ..... *H01B 7/282* (2013.01); *H01B 7/0009* (2013.01); *H01B 7/02* (2013.01); *H01B 7/18* (2013.01)

(58) Field of Classification Search
CPC ..... H01B 7/282
(Continued)

(56) References Cited

U.S. PATENT DOCUMENTS 7,297,871 B2 * 11/2007 Watanabe ..... B60R 16/0215 174/72 A
9,723,768 B2 8/2017 Huang et al.
(Continued)

FOREIGN PATENT DOCUMENTS

JP S62-193624 U 12/1987
JP 2008-305634 A 12/2008
JP 2016-058242 A 4/2016

OTHER PUBLICATIONS

International Search Report, Application No. PCT/JP2019/035129, dated Oct. 8, 2019. ISA/Japan Patent Office.

*Primary Examiner* — Krystal Robinson
(74) *Attorney, Agent, or Firm* — Honigman LLP

(57) ABSTRACT

A wiring member includes: a first electric wire; a braided wire that surrounds the first electric wire; a second electric wire; a resin; a sheath; and a ground wire that is electrically continuous with the braided wire. The braided wire surrounds the first electric wire, the second electric wire, and the braided wire. The sheath has a first end exposing the first electric wire, the second electric wire, and the braided wire. The braided wire has a second end exposing the first electric wire away from the first end. The resin seals, in a liquid-tight manner, the sheath and a region covered by the sheath, and the braided wire and a region surrounded by the braided wire. The first electric wire, the second electric wire, and the ground wire are exposed from the resin.

3 Claims, 4 Drawing Sheets

(51) Int. Cl.
*H01B 7/02* (2006.01)
*H01B 7/18* (2006.01)

(58) Field of Classification Search
USPC ..... 174/71 R
See application file for complete search history.

(56) References Cited

U.S. PATENT DOCUMENTS

| | | | | |
|---|---|---|---|---|
| 2002/0134565 | A1* | 9/2002 | Hashizawa | H01R 13/6592 174/370 |
| 2015/0090490 | A1* | 4/2015 | Sakka | H01B 7/0045 174/72 A |
| 2016/0189828 | A1* | 6/2016 | Oga | B60R 16/0215 174/72 A |
| 2018/0240571 | A1 | 8/2018 | Ning et al. | |

* cited by examiner

WIRING MEMBER

CROSS-REFERENCE TO RELATED APPLICATIONS

This application is the U.S. national stage of PCT/JP2019/035129 filed on Sep. 6, 2019, which claims priority of Japanese Patent Application No. JP 2018-179890 filed on Sep. 26, 2018, the contents of which are incorporated herein.

TECHNICAL FIELD

The present disclosure relates to a wiring member.

BACKGROUND

There is a technique for branching a multi-core shielded cable described in JP 2016-225081A. JP 2016-225081A proposes a technique for expanding the mesh of a braided shield and drawing out a core wire group around which the braided shield is provided.

It is advantageous to ground a shield conductor in view of making the shield more effective. From this viewpoint, the shield conductor is desirably branched from a conductor group in which the shield conductor is included.

However, JP 2016-225081A does not describe any technique for branching a braided shield from a multi-core shielded cable, let alone such a viewpoint.

Thus, an object of the present disclosure is to provide a technique for branching a shield conductor from a wiring member.

SUMMARY

A wiring member of the present disclosure includes a first electric wire, a second electric wire, a braided wire, a resin, a sheath, and a ground wire. The sheath surrounds the first electric wire, the second electric wire, and the braided wire. The sheath has a first end that exposes the first electric wire, the second electric wire, and the braided wire. The ground wire is electrically continuous with the braided wire. The braided wire surrounds the first electric wire. The braided wire has a second end that exposes the first electric wire away from the first end. The resin seals, in a liquid-tight manner, the sheath and a region covered by the sheath at least at the first end, and the braided wire and a region surrounded by the braided wire at least from the first end to the second end. The first electric wire, the second electric wire, and the ground wire are exposed from the resin.

Advantageous Effects of Disclosure

According to the present disclosure, the braided wire is branched as a shield conductor from the wiring member.

DETAILED DESCRIPTION OF PREFERRED EMBODIMENTS

First, embodiments of the present disclosure will be listed and described. The present disclosure is as follows:

A wiring member includes a first electric wire, a second electric wire, a braided wire, a resin, a sheath, and a ground wire. The sheath surrounds the first electric wire, the second electric wire, and the braided wire. The sheath has a first end that exposes the first electric wire, the second electric wire, and the braided wire. The ground wire is electrically continuous with the braided wire. The braided wire surrounds the first electric wire. The braided wire has a second end that exposes the first electric wire away from the first end. The resin seals, in a liquid-tight manner, the sheath and a region covered by the sheath at least at the first end, and the braided wire and a region surrounded by the braided wire at least from the first end to the second end. The first electric wire, the second electric wire, and the ground wire are exposed from the resin.

The braided wire is branched as a shield conductor from the wiring member. Intrusion of water from the first end into the inside of the sheath is suppressed. Intrusion of water into the braided wire is suppressed from the first end to the second end.

The ground wire is preferably also used as the braided wire. This wiring member allows the braided wire to be easily grounded.

Preferably, the ground wire has a core wire and a covering, the core wire is electrically connected to the braided wire, the covering surrounds the core wire and has a third end, the third end exposes the core wire toward the braided wire, and the resin further seals the core wire and the braided wire in a liquid-tight manner at least from the second end to the third end. This wiring member allows the braided wire to be easily grounded by the ground wire. Intrusion of water from a position where the ground wire is drawn out of the resin is suppressed.

Specific examples of the wiring member of the present disclosure will be described below with reference to the drawings. The present disclosure is not limited to these examples but is intended to include all modifications that are shown in the claims and are provided in senses and scopes equivalent to the claims.

First Embodiment

Hereinafter, a wiring member according to a first embodiment will be described. It should be noted that the "covering", "sheath", and "resin" described below all have insulating properties.

Figure 1:
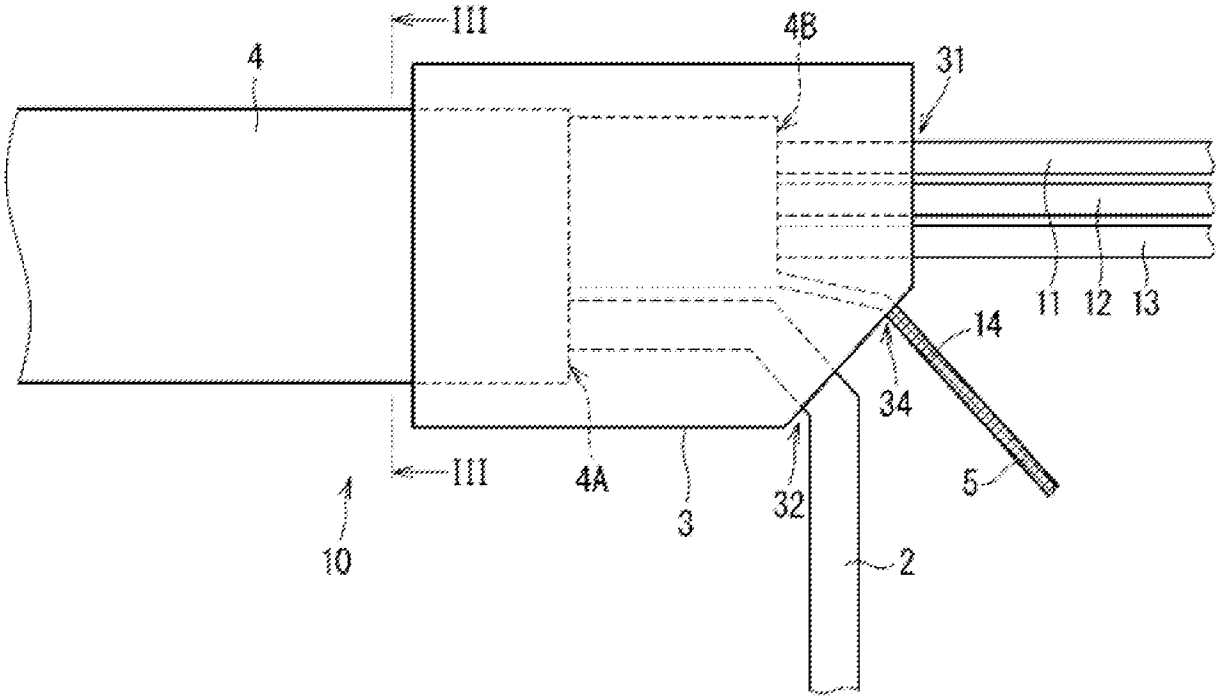
FIG. 1 is a schematic diagram illustrating a structure of a wiring member in a first embodiment.

FIG. 1 is a schematic diagram illustrating a structure of a wiring member 10 in the present embodiment, and shows only a portion where a shield conductor is branched from the wiring member 10 and the vicinity thereof. FIG. 1 is a side view of the portion seen from a direction approximately perpendicular to the direction in which the wiring member 10 extends. The wiring member 10 includes first electric wires 11, 12, and 13, a second electric wire 2, a resin 3, a sheath 4, and a braided wire 14. The sheath 4 surrounds the first electric wires 11, 12, and 13, the second electric wire 2, and the braided wire 14.

Figure 2:
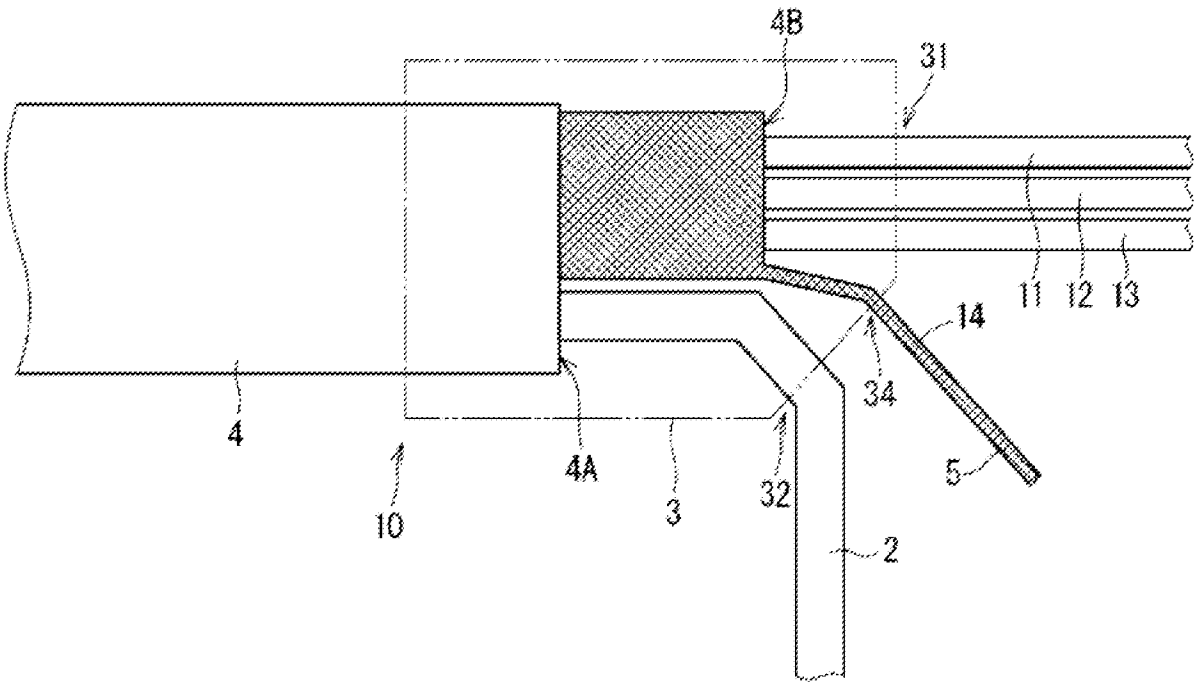
FIG. 2 is a schematic diagram illustrating a structure of the wiring member from which a resin has been virtually removed.

FIG. 2 is a schematic diagram illustrating a structure of the wiring member 10 from which the resin 3 has been virtually removed. FIG. 2 shows the position of the resin 3 by a chain double-dashed line that is a virtual line. FIG. 2 is designed to enhance the visibility of a region sealed by the resin 3.

Figure 3:
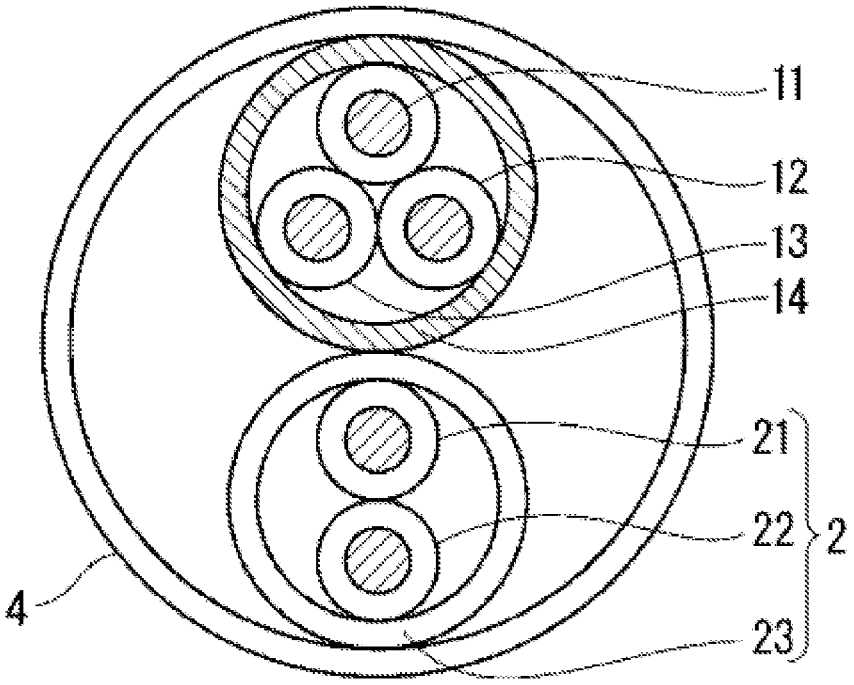
FIG. 3 is an illustrative cross-sectional view of a sheath, a first electric wire, a second electric wire, and a braided wire.

FIG. 3 is a cross-sectional view of the sheath 4, and the first electric wire 1 and the second electric wire 2 covered by the sheath 4, and shows a cross-section as taken along a position III-III in FIG. 1.

The first electric wires 11, 12, and 13 each have a core wire and a covering that surrounds the core wire.

The braided wire 14 is a shield conductor that shields the first electric wires 11, 12, and 13, and surrounds the first electric wires 11, 12, and 13. The wiring member 10 includes a ground wire 5, but in the present embodiment, the braided wire 14 is used also as the ground wire 5.

As a typical example, the first electric wires 11, 12, and 13 are power wires that transfer electric power. For example, when the wiring member 10 is installed in a vehicle, the first electric wires 11, 12, and 13 are utilized for the electric parking brake (EPB).

In the present embodiment, the second electric wire 2 has electric wires 21 and 22, and a covering 23 that covers these electric wires. The electric wires 21 and 22 each have a core wire and a covering that surrounds the core wire.

As a typical example, the second electric wire 2 is a signal wire that transmits signals. When the wiring member 10 is mounted in a vehicle, for example, the second electric wire 2 is used for the anti-lock brake system (ABS).

The sheath 4 has a first end 4A that exposes the first electric wires 11, 12, and 13, the second electric wire 2, and the braided wire 14. The braided wire 14 has a second end 4B that exposes the first electric wires 11, 12, and 13 away from the first end 4A.

The resin 3 seals, in a liquid-tight manner, the sheath 4 and a region covered by the sheath 4 at least at the first end 4A. This suppresses the intrusion of water from the first end 4A into the inside of the sheath 4.

The resin 3 further seals, in a liquid-tight manner, the braided wire 14 and a region surrounded by the braided wire 14 at least from the first end 4A to the second end 4B. This suppresses the intrusion of water into the braided wire 14 from the first end 4A to the second end 4B.

Referring to FIGS. 1 and 2, the resin 3 provides sealing in the following modes. Note that these modes of sealing are not essential, but rather are examples:

(i) The resin 3 also seals the outer circumference of the sheath 4, including the first end 4A;

(ii) The resin 3 also seals the outer circumferences of the first electric wires 11, 12, and 13 from the second end 4B to a position 31 away from the second end 4B;

(iii) The resin 3 also seals the outer circumferences of the first electric wires 11, 12, and 13 from the first end 4A to the position 31 away from the first end 4A;

(iv) The resin 3 seals the second electric wire 2 from the first end 4A to a position 32 away from the first end 4A; and (v) The resin 3 seals the braided wire 14 from the second end 4B to a position 34 away from the second end 4B.

The braided wire 14 (serving also as the ground wire 5), the first electric wires 11, 12, and 13, and the second electric wire 2 are drawn out of the resin 3.

As a typical example, the resin 3 is a urethane resin. For example, the resin 3 can be implemented by integral molding using a mold that has a convex portion and a concave portion forming a cavity in cooperation to surround the first end 4A. In the integral molding, the configuration from which the resin 3 is removed shown by the chain double-dashed line in FIG. 2 can be inserted into the mold, and the resin can be injected into the cavity by a known technique.

According to the wiring member 10 of the present disclosure, the shield conductor (the braided wire 14 in this case) is branched from the wiring member 10 through the resin 3. The branched braided wire 14 can be easily grounded. Since any known technique can be employed for a configuration for grounding the braided wire 14, FIGS. 1 and 2 do not show such a configuration. Similarly, since any known technique can be applied to processing of the first electric wires 11, 12, and 13 and the second electric wire 2 drawn out of the resin 3, FIGS. 1 and 2 do not show such processing.

According to the wiring member 10 of the present embodiment, the intrusion of water from the first end 4A into the inside of the sheath 4 is suppressed. The intrusion of water into the braided wire 14 is suppressed from the first end 4A to the second end 4B.

Second Embodiment

Awiring member according to a second embodiment will be described. In the description of the present embodiment, components similar to those described above in relation to the first embodiment are denoted by the same reference signs, and description thereof is omitted.

Figure 4:
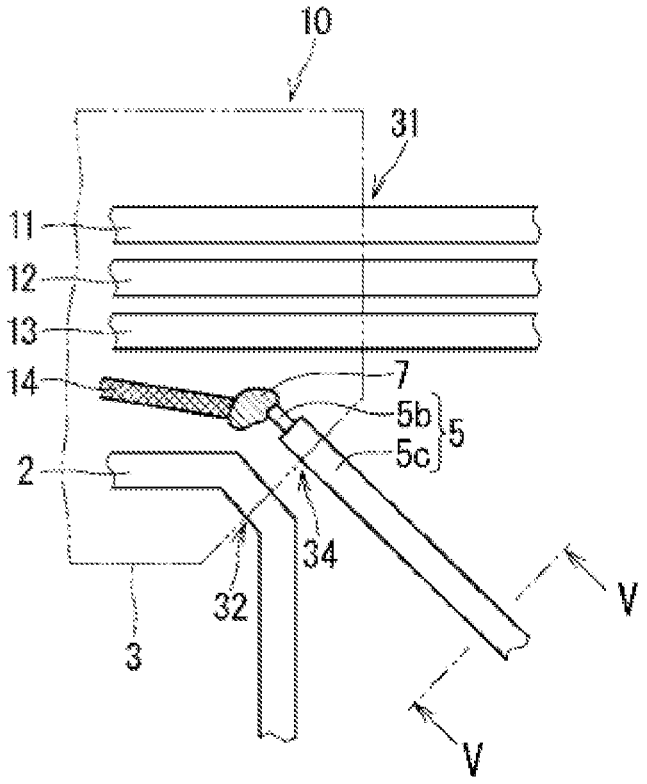
FIG. 4 is a schematic diagram illustrating a structure of a wiring member in a second embodiment.

FIG. 4 is a schematic diagram illustrating a configuration of a wiring member 10, which shows only a part different from the first embodiment and its vicinity. In the present embodiment, the wiring member 10 is provided with a ground wire 5 separately from the braided wire 14.

Figure 5:
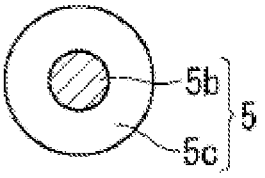
FIG. 5 is an illustrative cross-sectional view of a ground wire.

FIG. 5 is an illustrative cross-sectional view of the ground wire 5, and shows a cross-section as taken along a position V-V in FIG. 4. The ground wire 5 includes a core wire 5*b* and a covering 5*c*. The covering 5*c* surrounds the core wire 5*b*.

The covering 5*c* has a third end 5A that exposes the core wire 5*b* toward the braided wire 14. A connector 7 electrically connects the core wire 5*b* and the braided wire 14. That is, the ground wire 5 is electrically continuous with the braided wire 14.

The resin 3 further seals the core wire 5*b* and the braided wire 14 in a liquid-tight manner at least from the second end 4B to the third end 5A. More specifically, the ground wire 5 is brought out of the resin 3 at the position 34.

Referring to FIGS. 4 and 5, the resin 3 provides sealing in the following mode. Note that this mode of sealing is not essential, but rather is an example:

(vi) The resin 3 also seals the outer circumference of the covering 5*c*, including the third end 5A.

Figure 6:
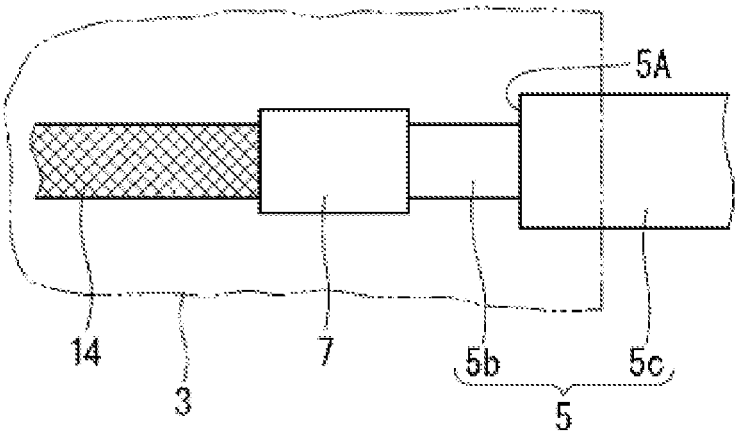
FIG. 6 is a schematic diagram showing a connector and its vicinity.

FIG. 6 is a schematic diagram illustrating the connector 7 and its vicinity. The braided wire 14 and the core wire 5*b* are connected via the connector 7. FIG. 6 illustrates a crimp sleeve as the connector 7. Soldering may be adopted as the connector 7.

According to the wiring member 10 of the present embodiment, the shield conductor (the braided wire 14 in this case) is branched from the wiring member 10 in the resin 3. The branched braided wire 14 can be easily grounded by the ground wire 5.

According to the wiring member 10 of the present embodiment, the intrusion of water from the position 34 where the ground wire 5 is drawn out is suppressed.

Supplementary Notes

In the first embodiment and the second embodiment, a configuration is possible in which the second electric wire 2 includes the electric wires 21 and 22, but the covering 23 is excluded. Alternatively, a configuration is possible in which the second electric wire 2 includes the electric wire 21, but the electric wire 22 and the covering 23 are excluded.

In the first embodiment and the second embodiment, a power wire may be employed as the second electric wire 2. If the second electric wire 2 includes a braided wire, the braided wire can be drawn out of the resin 3, like the braided wire 14 of the first embodiment. Alternatively, the braided wire can be connected to the ground wire 5 using the connector 7, like the braided wire 14 of the second embodiment.

In the second embodiment, the core wire 5*b* may be electrically connected to the braided wire 14 without the use of the connector 7. For example, the core wire 5*b* and the braided wire 14 may be welded together. In this case, the welded portion is also sealed by the resin 3.

The configurations described above in relation to the embodiments and modifications can be combined with each other as appropriate as long as no contradictions arise.

The invention claimed is:

1. A wiring member comprising:

a first electric wire;

a second electric wire;

a braided wire;

a resin;

a sheath; and a ground wire, wherein the sheath surrounds the first electric wire, the second electric wire, and the braided wire, the sheath has a first end that exposes the first electric wire, the second electric wire, and the braided wire, the ground wire is electrically continuous with the braided wire, the braided wire concentric to the first electric wire, wherein a portion of the first electric wire is disposed within the braided wire, the braided wire has a second end that exposes the first electric wire away from the first end, the resin seals, in a liquid-tight manner, the sheath and a region covered by the sheath at least at the first end, and the braided wire and a region surrounded by the braided wire at least from the first end to the second end, and the first electric wire, the second electric wire, and the ground wire are exposed from the resin.

2. The wiring member according to claim 1, wherein the ground wire is also used as the braided wire.

3. The wiring member according to claim 1, wherein the ground wire has a core wire and a covering, the core wire is electrically connected to the braided wire, the covering surrounds the core wire and has a third end, the third end exposes the core wire toward the braided wire, and the resin further seals the core wire and the braided wire in a liquid-tight manner at least from the second end to the third end.

* * * * *